US008905666B2

(12) United States Patent
Ooba

(10) Patent No.: US 8,905,666 B2
(45) Date of Patent: Dec. 9, 2014

(54) LIQUID APPLICATOR

(71) Applicant: Mitsubishi Pencil Company, Limited, Shinagawa-ku (JP)

(72) Inventor: Shigeki Ooba, Fujioka (JP)

(73) Assignee: Mitsubishi Pencil Company, Limited, Shinagawa-Ku, Tokyo (JP)

( * ) Notice: Subject to any disclaimer, the term of this patent is extended or adjusted under 35 U.S.C. 154(b) by 0 days.

(21) Appl. No.: 14/167,598

(22) Filed: Jan. 29, 2014

(65) Prior Publication Data

US 2014/0241781 A1 Aug. 28, 2014

(30) Foreign Application Priority Data

Jan. 31, 2013 (JP) ..... 2013-017118

(51) Int. Cl.
*B43K 5/00* (2006.01)
*B05C 17/00* (2006.01)
*B05C 11/00* (2006.01)

(52) U.S. Cl.
CPC ..... *B05C 17/00* (2013.01); *B05C 11/00* (2013.01)
USPC ..... 401/202; 401/188 A; 401/117

(58) Field of Classification Search
CPC ..... B43K 3/04; B43K 8/02; B43K 8/022; B43K 8/024; B43K 8/026; B43K 8/24; B43K 23/08; B43K 23/12; B43K 23/128; B43K 24/02; B43K 24/08; B43K 24/082; B43K 24/084; A46B 11/0079; A46B 11/0089
USPC ..... 401/202, 262, 269, 99, 109, 112, 113, 401/91, 92, 107, 108, 188 A
See application file for complete search history.

(56) References Cited

U.S. PATENT DOCUMENTS

| | | | | |
|---|---|---|---|---|
| 5,044,523 | A * | 9/1991 | McNab | 222/207 |
| 7,384,208 | B2 * | 6/2008 | Bouix et al. | 401/269 |
| 2005/0169695 | A1 | 8/2005 | Noguchi | |
| 2009/0097899 | A1 * | 4/2009 | Carroll | 401/109 |

FOREIGN PATENT DOCUMENTS

| | | | |
|---|---|---|---|
| JP | 2005-212418 | A | 8/2005 |
| JP | 2006-271653 | A | 10/2006 |
| JP | 2009-285255 | A | 12/2009 |
| JP | 2012-000831 | A | 1/2012 |

* cited by examiner

*Primary Examiner* — David Walczak
(74) *Attorney, Agent, or Firm* — Buchanan, Ingersoll & Rooney PC

(57) ABSTRACT

When the cap is released, the application body that is urged to the applicator front end side slides to the applicator front end side, and in this condition, the click button is actuated in linkage by the inclined part of the click button being pushed by the application body projection so that the click button moves up and juts out from the peripheral side of the front barrel and the valve set opens at approximately the same time. Upon usage, when the jutting click button is pushed and released, the application body is slid in the axial direction by the abutment between the inclined part of the click button and the applicator body projection so as to be able to open and close the valve set.

3 Claims, 14 Drawing Sheets

10
10b
12
14
16
18
22
28
28a
28b
32
34
10a 10
12
28

10
34
14
12
22
28b
28
18
28a
16

10
12
32
28

10
34
14
12a
12
32
22
28
18
16

10
12
32
18
16
28

10
34
38
36
44
12
22
18
16
28

10
32
12
18
16
28

10
34
38
42
36
40
20b
32
20
12
22
18
16
28

LIQUID APPLICATOR

This Nonprovisional application claims priority under 35 U.S.C. §119(a) on Patent Application No. 2013-017118 filed in Japan on 31 Jan. 2013, the entire contents of which are hereby incorporated by reference.

BACKGROUND OF THE INVENTION (1) Field of the Invention

The present invention relates to a liquid applicator such as a felt pen (writing implement), nail art pen (cosmetic) and the like having a structure that delivers a liquid by opening and closing a valve when a writing point is pumped.

(2) Description of the Prior Art

Conventionally, there has been a well-known structure for liquid applicators, which delivers the liquid as a valve rod of a valve set is opened in linkage with pumping the writing point. When pumping is released, the valve rod of the valve set is closed.

In this case, it is necessary to choose a place for pumping, which causes inconvenience. When the applicator is pumped on the surface of paper, there is a risk of an excessive amount of liquid coming out and spoiling the surface of paper.

Further, since in this mechanism the valve rod of the valve set is moved open and closed by means of the writing point, a writing implement using a brush or other soft material as its writing tip cannot use this structure. That is, this structure is applied only to writing implements using a hard material as the writing tip such as a plastic pen core made of POM (polyacetal).

Even if a hard material is used, there has been still a problem that the tip is damaged due to excessive force on the tip during pumping so that a fine line cannot be drawn, particularly in a case of a plastic pen core.

To deal with this, there have been disclosures of technologies (Patent Documents 1 to 4 described below) in which the liquid can be delivered by a pressing operation of a click button without the need of pumping.

Japanese Patent Application Laid-open 2012-831 (:Patent Document 1) discloses a side clicking type applicator having a clicking mechanism and a valve mechanism arranged in the rear of a pen core.

Japanese Patent Application Laid-open 2006-271653 (:Patent Document 2) discloses a side clicking type fluid cosmetic container which delivers a predetermined amount of a cosmetic fluid to a brush by moving a disk inside a cartridge.

Japanese Patent Application Laid-open 2005-212418 (:Patent Document 3) discloses a side clicking type propelling mechanism which delivers a material to be applied by rotating an inner sleeve inside the front barrel to push a piston forward as a side click button is operated.

Japanese Patent Application Laid-open 2009-285255 (:Patent Document 4) discloses a side clicking type liquid propelling device in which a slide valve with a slide packing pushes a liquid from a tank portion to a liquid passage by a side clicking operation and cuts off the communication between the liquid passage and tank portion by releasing the click. This device is configured so that the click button is hidden by a cap when unused.

However, in Patent Document 1, since the click button is projected, there is a risk that the click button is clicked by mistake and the liquid is delivered wastefully, depending on the state of storage during nonusage.

Further, in Patent Documents 2 and 3, since the piston is driven as the click button is pressed, a strong force is needed to push the piston so that the liquid is hard to deliver.

Moreover, in Patent Document 4, since the click button is configured to be hidden by the cap, the cap becomes bulky so that the design is limited.

SUMMARY OF THE INVENTION

The present invention has been devised in view of the above circumstances, it is therefore an object of the present invention to provide a liquid applicator, which includes a click button that allows an application liquid to be delivered by a pressing operation thereof and is housed so that the application liquid will not unintentionally come out when the applicator is kept during nonusage, and which enables easy clicking operation with a weak force when the applicator is used.

The present invention resides in a liquid applicator comprising:

a barrel body with an opening for holding a content liquid therein;

a front barrel;

a valve set held and fixed between the opening of the barrel body and the front barrel;

an application body, integrally formed of an application core, a holder for the application core and an ink feed pipe, and disposed inside the front barrel, the application body being urged by a spring to a front end side of the applicator, slidable in an axial direction and slidable in the valve set, the ink feed pipe being sealed by a packing inside the valve set;

a cap fitted to the front barrel and having a sealing part with the application body; and, a click button arranged on a peripheral side of the front barrel to open and close the valve set, and wherein an inclined portion formed in the click button is engaged with an application body projection provided for the application body in such a manner that the application body moves forward and backward in the axial direction of the barrel body as the click button moves up and down from the peripheral side of the front barrel in a radial direction of the front barrel, the application body that is urged to the applicator front end side slides to the applicator front end side when the cap is released, and upon this, the click button is actuated in linkage by an inclined part of the click button being pushed by the application body projection so that the click button moves up and juts out from the peripheral side of the front barrel and the valve set opens at approximately the same time, upon usage, when the jutting click button is pushed and released, the application body is slid in the axial direction by the abutment between the inclined part of the click button and the application body projection so as to be able to open and close the valve set, and, when the cap is closed, the application body that is urged to the applicator front end side is slid to the barrel body side, and another inclined part of the click button pushes another projection of the application body so that the click button moves down in linkage therewith and retracts into the front barrel, and the valve set is closed at the same time.

It is preferable in the present invention that a valve rod is arranged inside the valve set so as to integrally operate with the application body, deliver the liquid, and cut off an interior of the barrel body from the application core when the cap is released.

It is also preferable in the present invention that the cap and the front barrel are screw fitted to each other.

According to the liquid applicator of the present invention, the click button moves up and down as the cap is fitted and removed, so that the user can get pleasure in design from its external appearance.

In the case of the liquid applicator described in Claim 1, pumping is done by the click button instead of the writing point, there is here no risk of the pen core from being damaged when the valve set is pumped.

Further, when the cap is released, the click button juts out, whereas the click button is retracted when the cap is fitted. Accordingly, it is possible prevent malfunction during non-usage and the applicator can be easily put into a case, etc., because of no projection.

In the present invention, provision of a structure in which a valve rod is arranged inside the valve set and integrally operates with the application body to deliver the liquid and cut off the interior of the barrel body from the application core when the cap is released, produces the effect of delivering the content liquid from the barrel body that is at negative pressure. Further, even when the cap remains open, the valve is closed so that there is no fear of liquid leakage.

Furthermore, use of screw fitting between the cap and the front barrel produces excellent effect such as securely fixing the application body that is urged to the writing point side.

DESCRIPTION OF THE PREFERRED EMBODIMENTS

The embodiments of the present invention will hereinafter be described in detail with reference to the accompanying drawings.

FIGS. 1 to 9 are illustrative diagrams of a liquid applicator according to the first embodiment of the present invention.

Figures 1A, 1B, 1C, 1D:
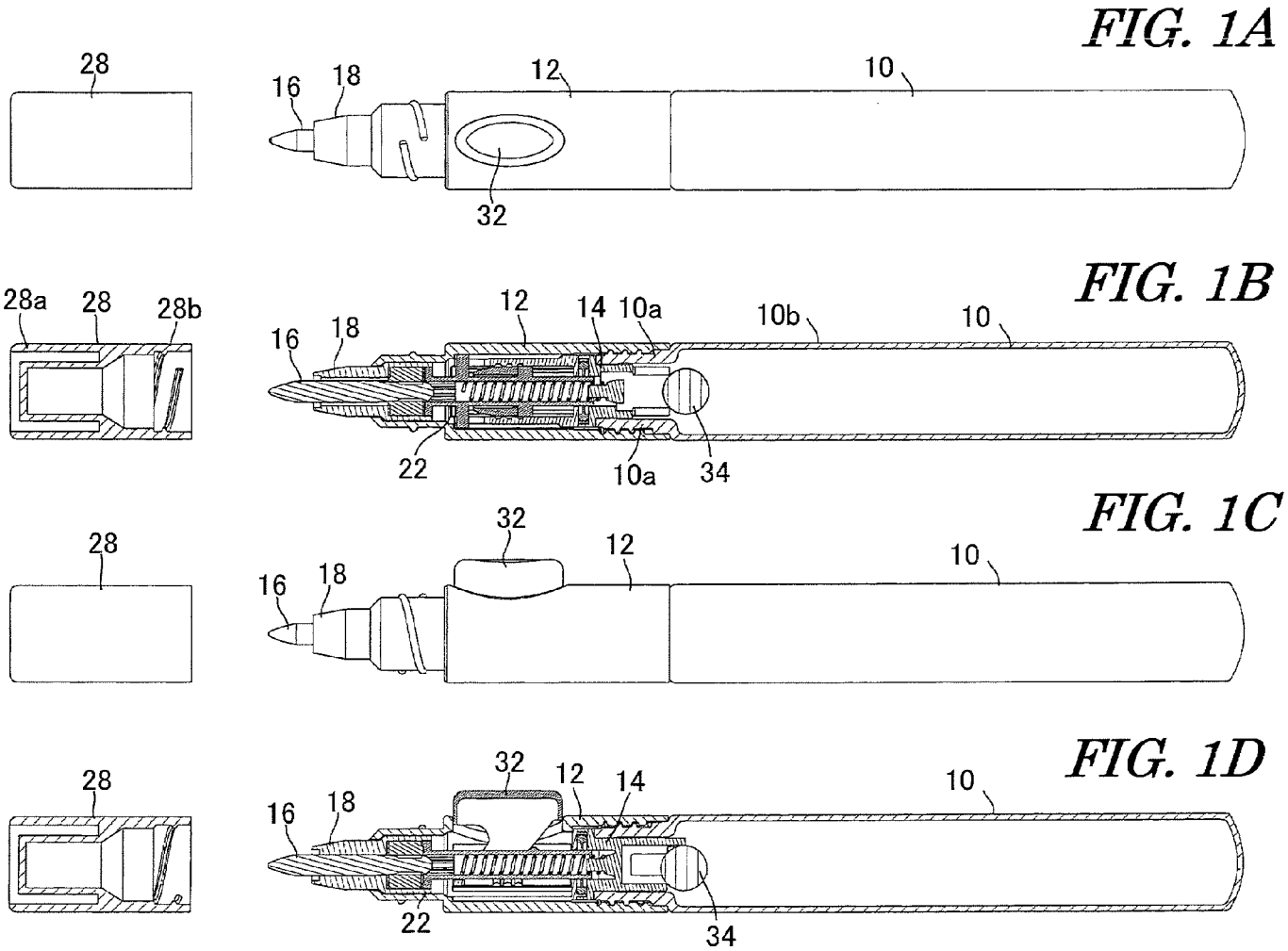
FIGS. 1A to 1D are illustrative diagrams showing a liquid applicator according to the first embodiment of the present invention with its cap removed, FIG. 1A a side view from the click button side, FIG. 1B a vertical sectional view of FIG. 1A, FIG. 1C a side view with the click button put upward, and FIG. 1D a vertical sectional view of FIG. 1C.
Figures 2A, 2B, 2C, 2D:
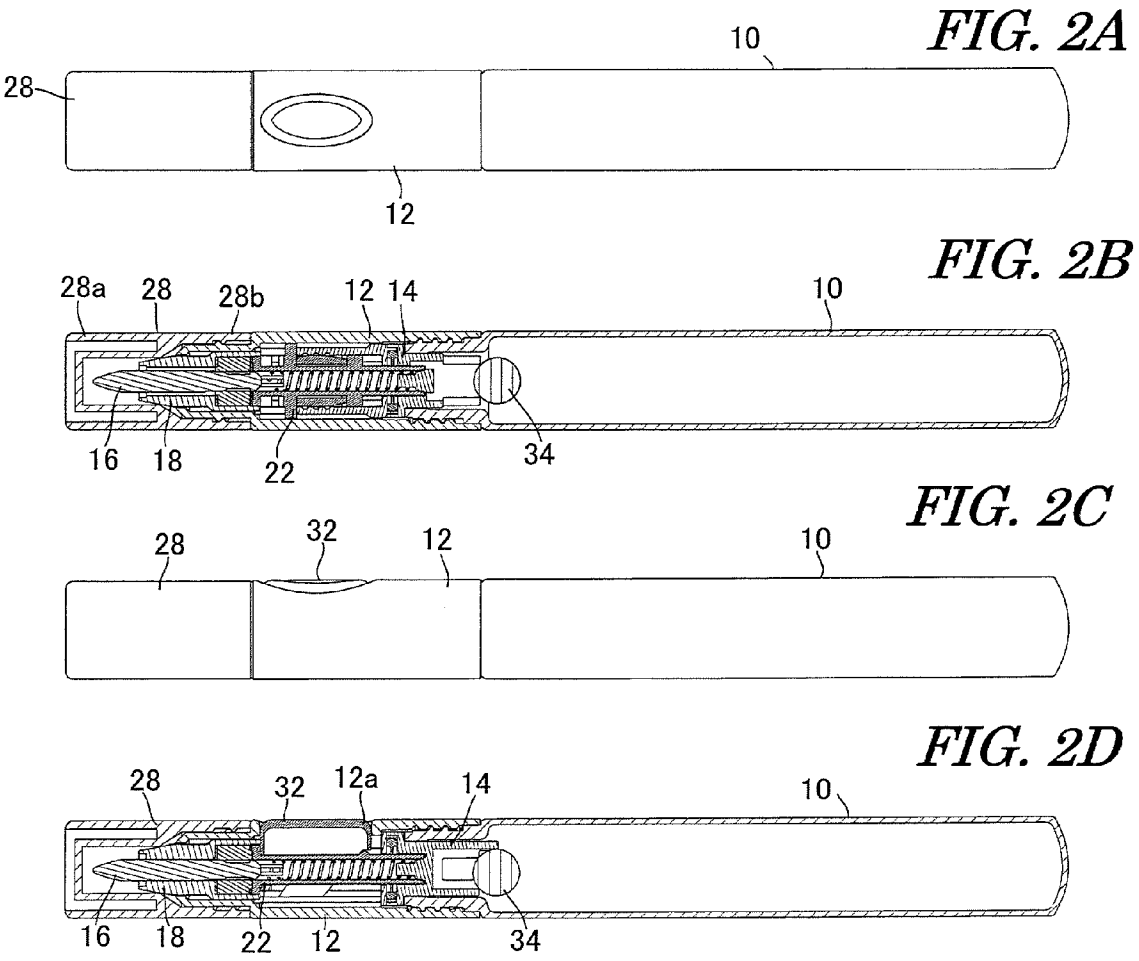
FIGS. 2A to 2D are illustrative diagrams showing the same liquid applicator with its cap attached, FIG. 2A a side view from the click button side, FIG. 2B a vertical sectional view of FIG. 2A, FIG. 2C a side view with the click button put upward, and FIG. 2D a vertical sectional view of FIG. 2C.
Figures 3A, 3B:
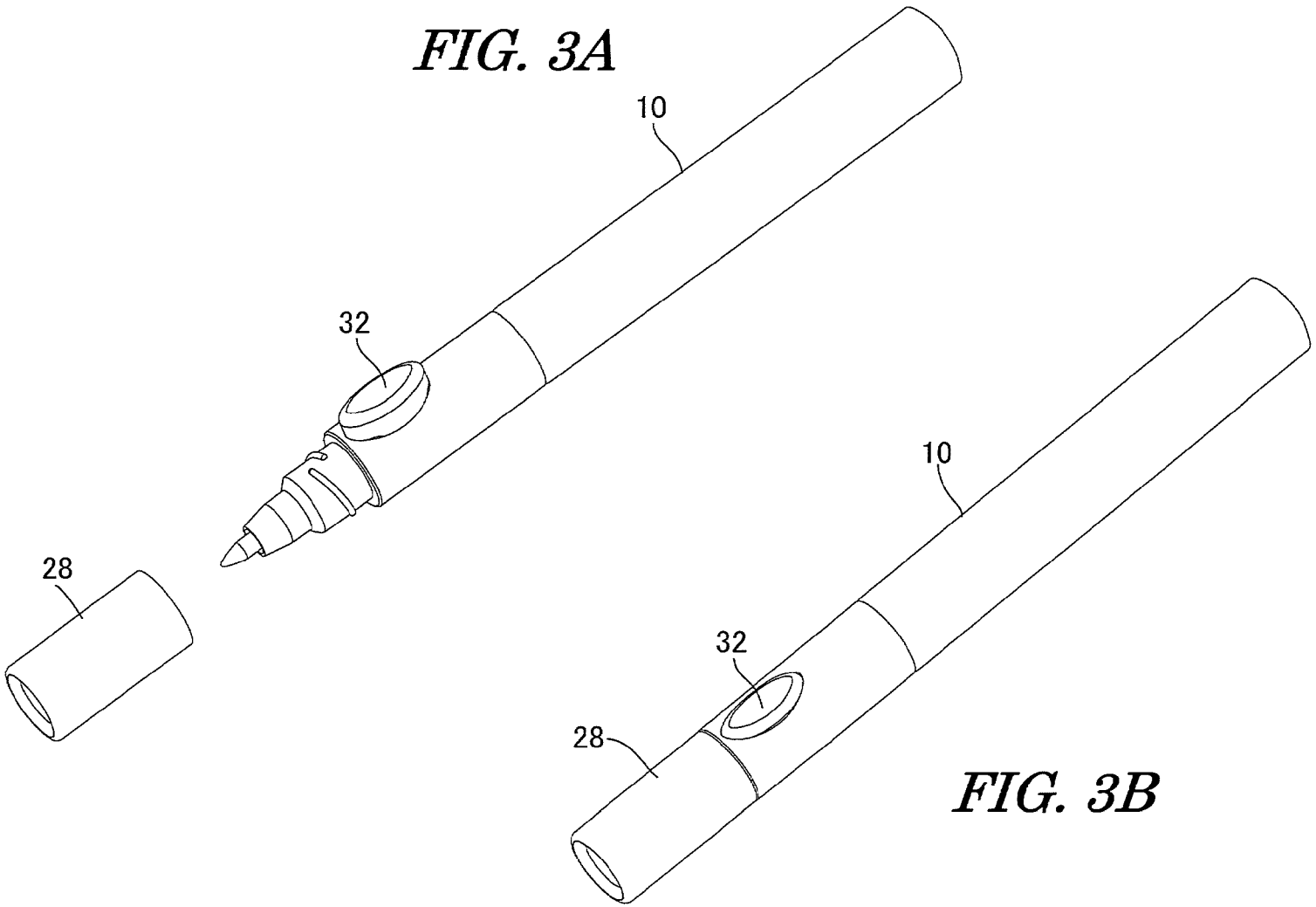
FIGS. 3A and 3B are perspective diagrams showing the same liquid applicator, FIG. 3A an illustrative view with its cap removed and FIG. 3B an illustrative view with the cap attached.
Figures 4A, 4B:
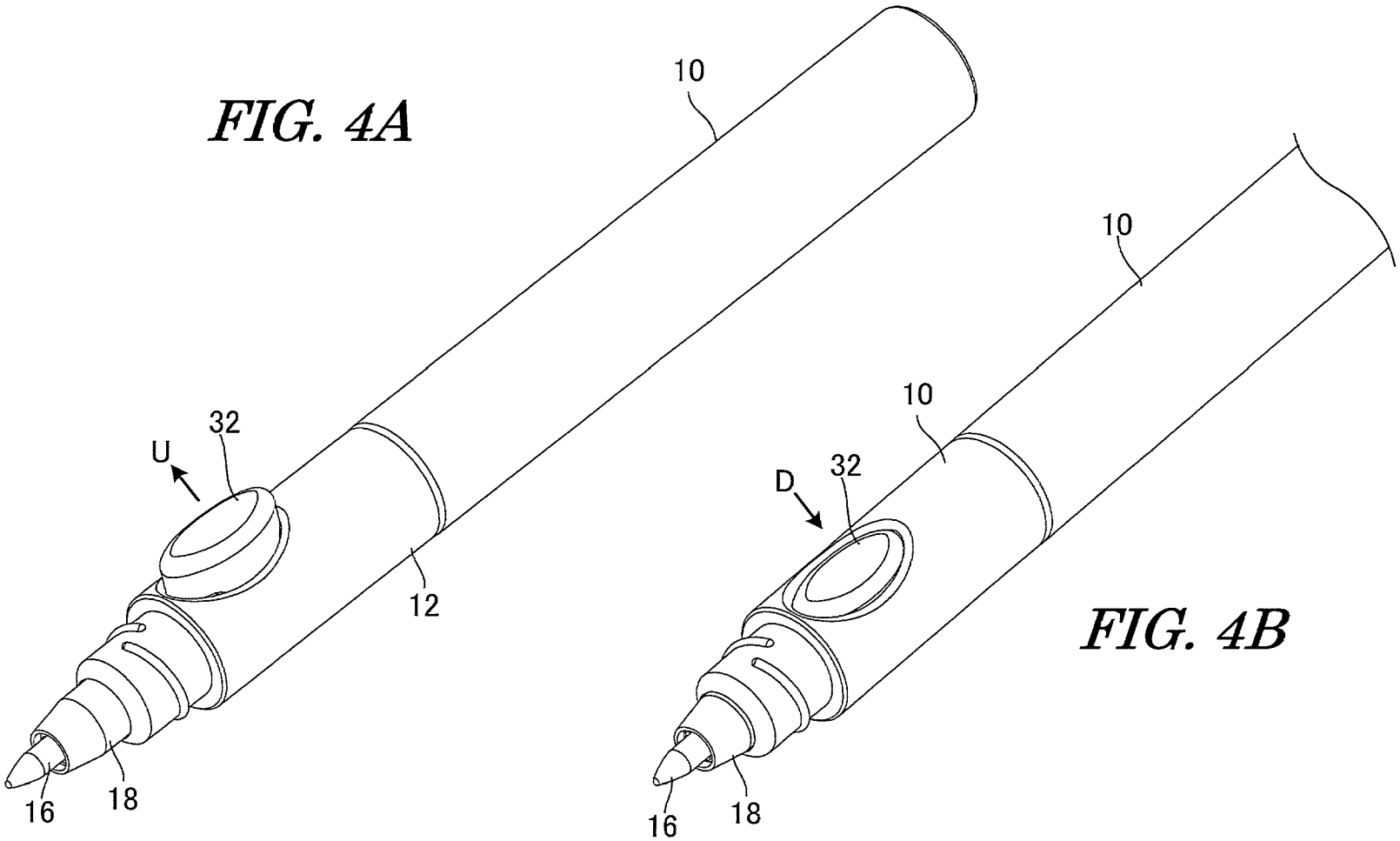
FIGS. 4A and 4B are enlarged perspective diagrams showing the front end side of the same liquid applicator, FIG. 4A an illustrative view with the click button unpressed and FIG. 4B an illustrative view with the click button pressed.

FIGS. 1 to 4 are overall illustrative diagrams of the liquid applicator, FIG. 1 showing a state with the cap removed, FIG. 2 showing a state with the cap fitted, FIGS. 3A and 3B showing states of the cap removed and fitted, respectively, and FIG. 4 showing a state of the cap removed. FIG. 5 is a detailed enlarged view of the front end part of the liquid applicator, FIG. 6 an assembly diagram of a click button and an application body of the liquid applicator, and FIGS. 7 and 8 showing an ink feed pipe and a click button of the same liquid applicator, respectively.

As shown in FIGS. 1 to 4, a content liquid is stored in a barrel body 10. Arranged at an opening 10*a* of barrel body 10 is a valve set 14 fixed and held between the opening 10*a* and a front barrel 12.

Arranged inside front barrel 12 is an application body 22 that is integrally formed of an application core 16, a plastic mouth 18 as a holder for the core and an ink feed pipe 20.

Application body 22 is urged toward the front end side of application core 16 by a spring 24, can slide in the axial direction and can also slide inside valve set 14.

Ink feed pipe 20 is sealed by a packing 26 inside the above valve set 14. A cap 28 is fitted on front barrel 12 and has a sealing part 30 with application body 22.

The liquid applicator has a click button 32 for opening and closing valve set 14 on the peripheral side of front barrel 12. (Cap 28)

As shown in FIGS. 1, 2 and 5, cap 28 is formed such that the part covering the tip of application core 16 is formed thin and a cylindrical part 28*a* is extended therearound. A female thread is formed on the interior of a rear end part 28*b* of cap 28. The outer circumference in the front part of rear end part 28*b* of cap 28 is reduced stepwise in diameter and an inner sleeve 28*c* is formed on the outer circumference of the first frequency band front end part.

When cap 28 is attached to the applicator at the time of nonusage, the female thread inside rear end part 28*b* of cap 28 is screw engaged with the male thread in the front end part of front barrel 12 to establish closure.

(Barrel Body 10)

As shown in FIGS. 1 and 2, barrel body 10 is smaller in diameter in opening portion 10*a* at the front end than main part 10*b*. The main part 10*b* forms an application liquid reservoir enclosed except opening portion 10*a*. An agitation ball 34 for agitating the application liquid is put inside main part 10*b*.

(Front Barrel 12)

As detailedly shown in FIG. 5, front barrel 12 is an overall cylinder extending from the front to the rear with an opening 12*a* formed in part on the peripheral side wall. A female thread 12*b* on the interior surface in the rear end part is engaged with the male thread formed on the outer periphery of opening portion 10*a* of the barrel body, so that the front barrel is fixed to barrel body 10. Click button 32 is fitted to this opening 12*a* in such a manner that the click button moves up and down with respect to the peripheral side of front barrel 12 in the radial direction of front barrel 12.

(Valve Set 14)

Valve set 14 is held and fixed between opening portion 10*a* of barrel body 10 and front barrel 12. Specifically, of valve set 14, an approximately cylindrical valve seat 14*a* is fitted into opening portion 10*a*. The front part of valve seat 14*a* is enlarged in diameter like a flange and abuts the front end of the opening portion 10*a* and is also held and fixed between the opening portion and front barrel 12. The large-diametric flange-like part in the front part of valve seat 14*a* has hollow interior, in which packing 26 of valve set 14 is fitted. Packing 26 comes in sliding contact with the outer peripheral surface of ink feed pipe 20 so as to prevent the application liquid from leaking forward from valve seat 14*a*. Here, packing 26 may use various kinds of flexible resin such as polyethylene, rubber, silicone rubber, and elastomer.

Formed inside valve seat 14*a* is a valve set sealing part 14*b* tapered conically forward. The rear end opening of ink feed pipe 20 comes into and out of contact with this valve set sealing part 14*b* so as to close and open the communication of the application liquid reservoir (the space inside main part 10*b*) with ink feed pipe 20. The outer periphery of valve set sealing part 14*b* is fixed to the inner wall of valve seat 14*a* by ribs that form openings therebetween so that the application liquid can flow through the gaps between ribs (see FIG. 1B).

The rear end side of valve seat 14*a* is formed with comb-like clearances so that if agitation ball 34 abuts, flow of the application liquid between the interior space of main part 10*b* and valve seat 14*a* is assured.

(Application Body 22)

Provided inside front barrel 12 is application body 22 that is integrally formed of application core 16, plastic mouth 18 and ink feed pipe 20. Application core 16 forms a tapered pen core, which may use various structures such as a brush-like part of a bundle of fibers impregnated with the application liquid, fiber molded material, continuous porous material, and resin mold having application liquid guide grooves presenting capillary force.

Plastic mouth 18 covers application core 16 from the outer peripheral side so as to be able to guide the core forward and backward, and is provided with a porous sponge piece 18*a* as a temporal retainer of the application liquid.

The rear end of application core 16 is fitted into the front end of ink feed pipe 20 to establish communication. The tubular ink feed pipe 20 is extended to valve set 14 and has a spring 24 arranged therein. Application body 22 is urged to the front side of application core 16 by means of this spring 24 and can move in the axial direction while the rear end of ink feed pipe 20 can slide inside valve set 14. The rear end of spring 24 is locked on valve set sealing part 14*b* of valve set 14 while the front end is locked inside the front end part of ink feed pipe 20, so that when ink feed pipe 20 is moved rearward, opposing the urging force of the spring 24 by operating click button 32, application body 22 as a whole moves rearwards up to a predetermined position, where valve set sealing part 14*b* fits into the rear end opening of ink feed pipe 20 to close this opening.

(Click Button 32)

As shown in FIG. 1 and others, click button 32 has a clicking part 32*b* of an oval shape when viewed from the moving direction, and comes out of and into opening 12*a* on the peripheral side of front barrel 12 as the user operates.

Figure 6A:
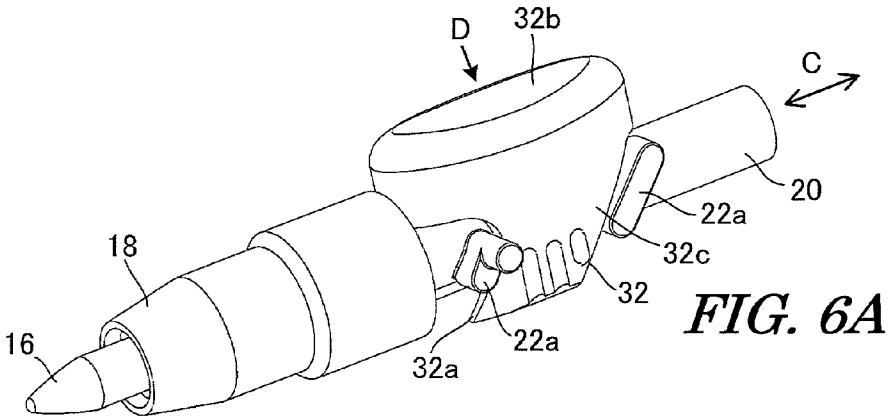
FIGS. 6A and 6B are assembly diagrams of a click button and an application body of the same liquid applicator, FIG. 6A an illustrative view with the click button pressed, and FIG. 6B an illustrative view with the click button unpressed.
Figure 6B:
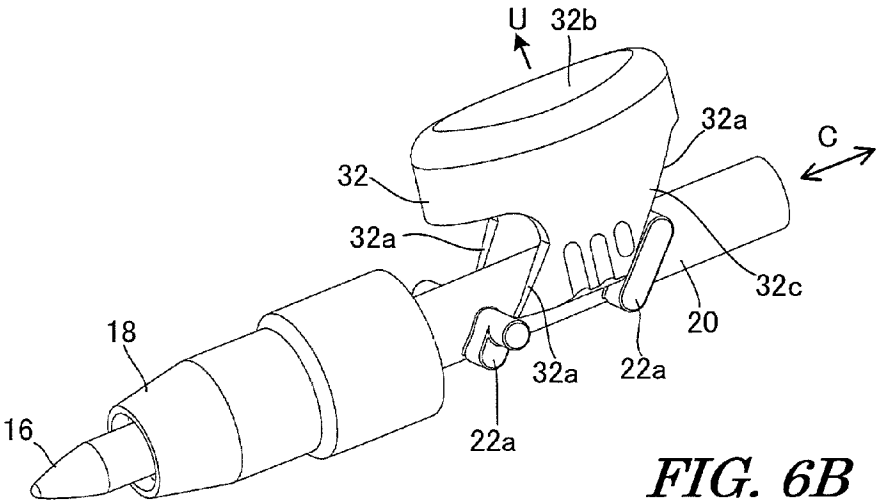
Figure 7C:
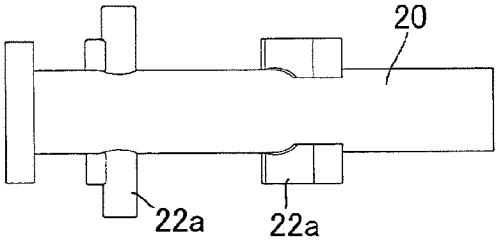
FIGS. 7A to 7G are part drawings of an ink feed pipe of the same liquid applicator, FIG. 7A a view from the front end side, FIG. 7B a perspective view from the front end side, FIG. 7C a side view from the attachment side of a click button, FIG. 7D a side view from another side, FIG. 7E a vertical sectional view, FIG. 7F a view from the rear end side, and FIG. 7G a perspective view from the rear end side.
Figure 7D:
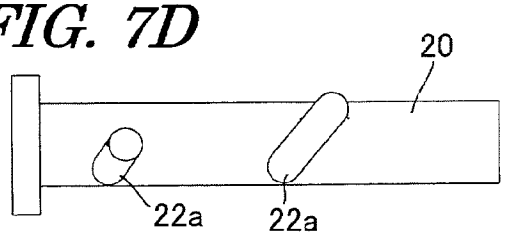
Figure 7E:
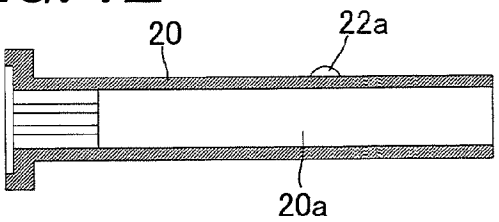
Figure 7F:
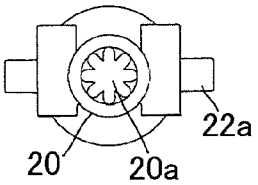
Figure 7G:
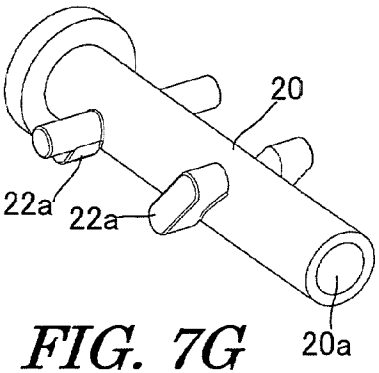
Figure 7A:
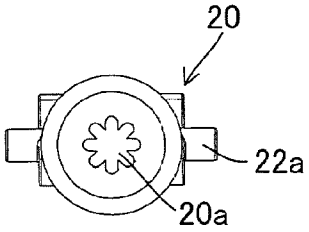
Figure 7B:
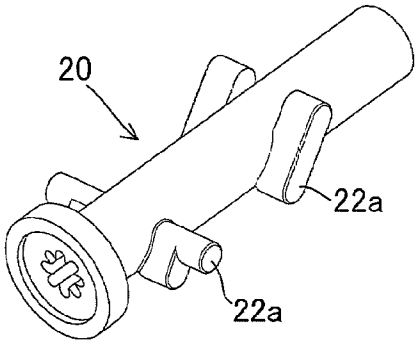
Figure 8E:
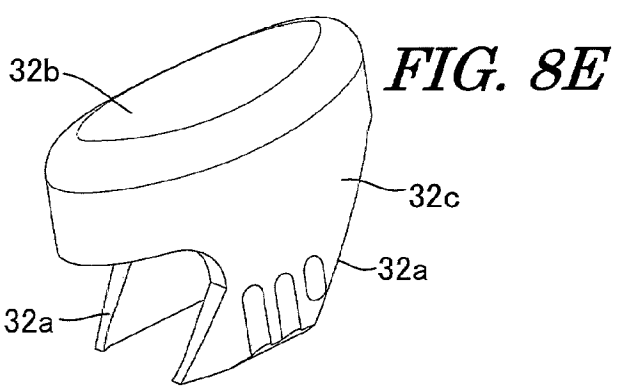
FIGS. 8A to 8G are part drawings of a click button of the same liquid applicator, FIG. 8A a view from the front end side, FIG. 8B a plan view from the pressing side, FIG. 8C a side view, FIG. 8D a vertical sectional view along the axial direction, FIG. 8E a perspective view, FIG. 8F a view from the rear end side, and FIG. 8G a vertical sectional view cut across the axial direction.
Figure 8G:
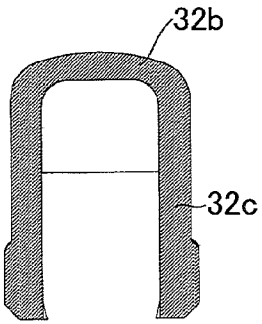
Figure 8F:
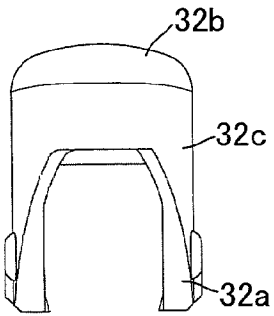
Figure 8B:
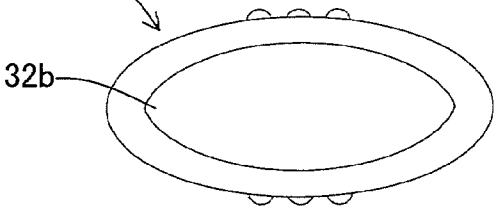
Figure 8C:
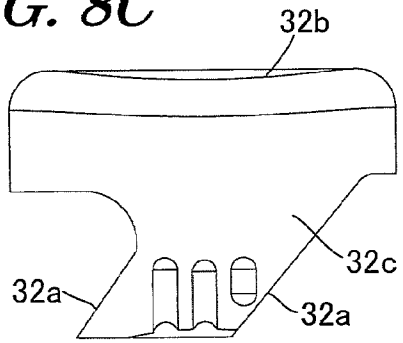
Figure 8D:
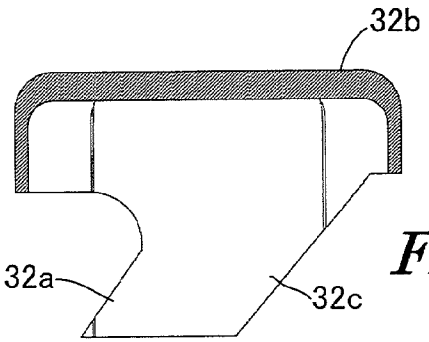
Figure 8A:
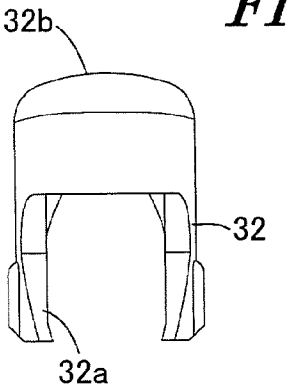

In FIG. 6, "U" and "D" respectively denote the upward and downward movements of click button 32 in the radial direction of front barrel 12 (the direction perpendicular to the center axis) through opening 12 on the peripheral side of front barrel 12.

Click button 32 has a roughly saddle shaped configuration, that is, clicking part 32*b* bifurcates along the upward U to downward D direction, forming a forked part 32*c* on the opposite side, so that ink feed pipe 20 passes through the interior of the saddle shaped forked part 32*c*. This forked part 32*c* has inclined portions 32*a* in the front and rear along the axial direction of barrel body 10.

(Ink Feed Pipe 20)

Ink feed pipe 20 is a tubular body having a large-diametric, flange-shaped front end part and a through hole 20*a* with its front end star-shaped, as shown in FIG. 7. Ink feed pipe 20 has projections 22*a* at two sites on the side surface in the longitudinal direction of ink feed pipe 20. Each projection 22*a* is formed with an inclined facet in the corresponding position that abuts the aforementioned inclined portion 32*a* of click button 32.

(Cooperative Movement of Click Button 32 and Ink Feed Pipe 20)

Inclined portions 32*a* provided in click button 32 and application body projections 22*a* provided on ink feed pipe 20 of application body 22 are engaged with one another, so that when click button 32 is moved up and down (in the U- and D-directions) in the radial direction of front barrel 12 from opening 12*a* on the peripheral side of front barrel 12, application body 22 moves forward and rearward with respect to the axial direction of barrel body 10 (denoted by "C" in FIG. 6), as shown in FIGS. 1, 4 and 6.

Here, each component such as barrel body 10, plastic mouth 18 of application body 22, ink feed pipe 20, and cap 28 may be formed of various kinds of material such as resin material (e.g., polypropylene, polyethylene, polyacetal, and mixture of multiple resins). As spring 24, SUS may be used.

Next, the operation of the liquid applicator of the first embodiment will be described.

Figure 5A:
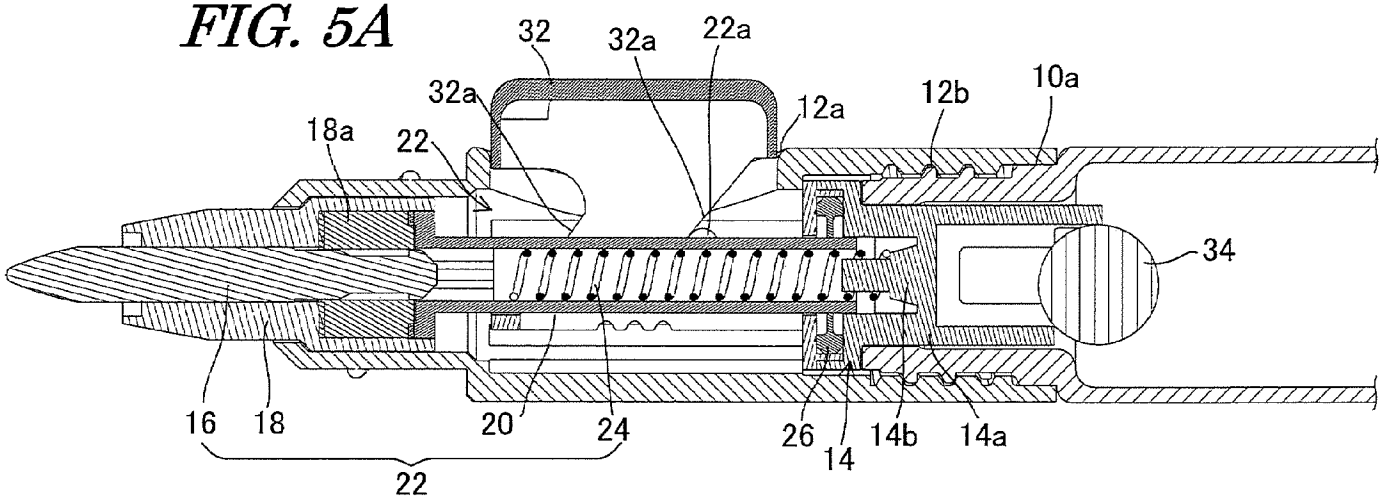
FIGS. 5A and 5B are enlarged vertical sectional diagrams showing the front side of the same liquid applicator, FIG. 5A an illustrative view with the cap removed and FIG. 5B an illustrative view with the cap attached.

In the liquid applicator, as shown in FIGS. 1, 3A and 5A, when cap 28 is taken off, application body 22 urged to the front end side of the applicator slides to the front end side of the applicator.

In this condition, inclined portion 32*a* of click button 32 is pushed by the application body projections 22*a*, whereby click button 32 moves in linkage therewith, and click button 32 moves up and projects from the peripheral side of front barrel 12 while valve set 14 opens at the same time.

Upon usage, when the projected click button 32 is pressed and released, application body 22 is moved in the axial direction by the abutment of inclined portion 32*a* of click button 32 against application body projection 22*a*, whereby valve set 14 can be open and closed.

Figure 5B:
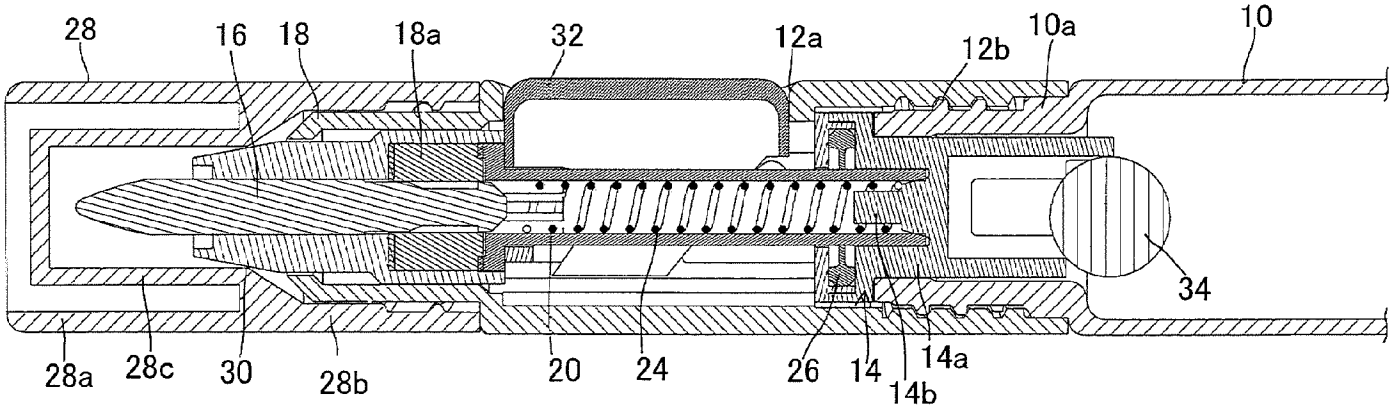

On the other hand, when cap 28 is fitted, application body 22 that is urged to the front end side of the applicator is slid to the barrel body 10 side, as shown in FIGS. 2, 3B and 5B.

In this condition, the other inclined portion 32*a* of click button 32 is pushed by the other projection 22*a* of application body 22, whereby click button 32 moves down in linkage therewith and retracts into front barrel 12, and valve set 14 is closed at the same time.

According to the liquid applicator of the first embodiment, since click button 32 moves up and down as cap 28 is fitted and removed, the user can get pleasure in design from its external appearance.

Further, when cap 28 is released, click button 32 juts out, whereas click button 32 is put back when cap 28 is fitted. Accordingly, it is possible to prevent malfunction during nonusage and the applicator is easy to be put into a case, etc., because of no projection.

Moreover, since pumping is done by click button 32 instead of the writing point, there is no risk of application core 16 from being damaged when valve set 14 is pumped.

Figures 9A, 9B, 9C, 9D:
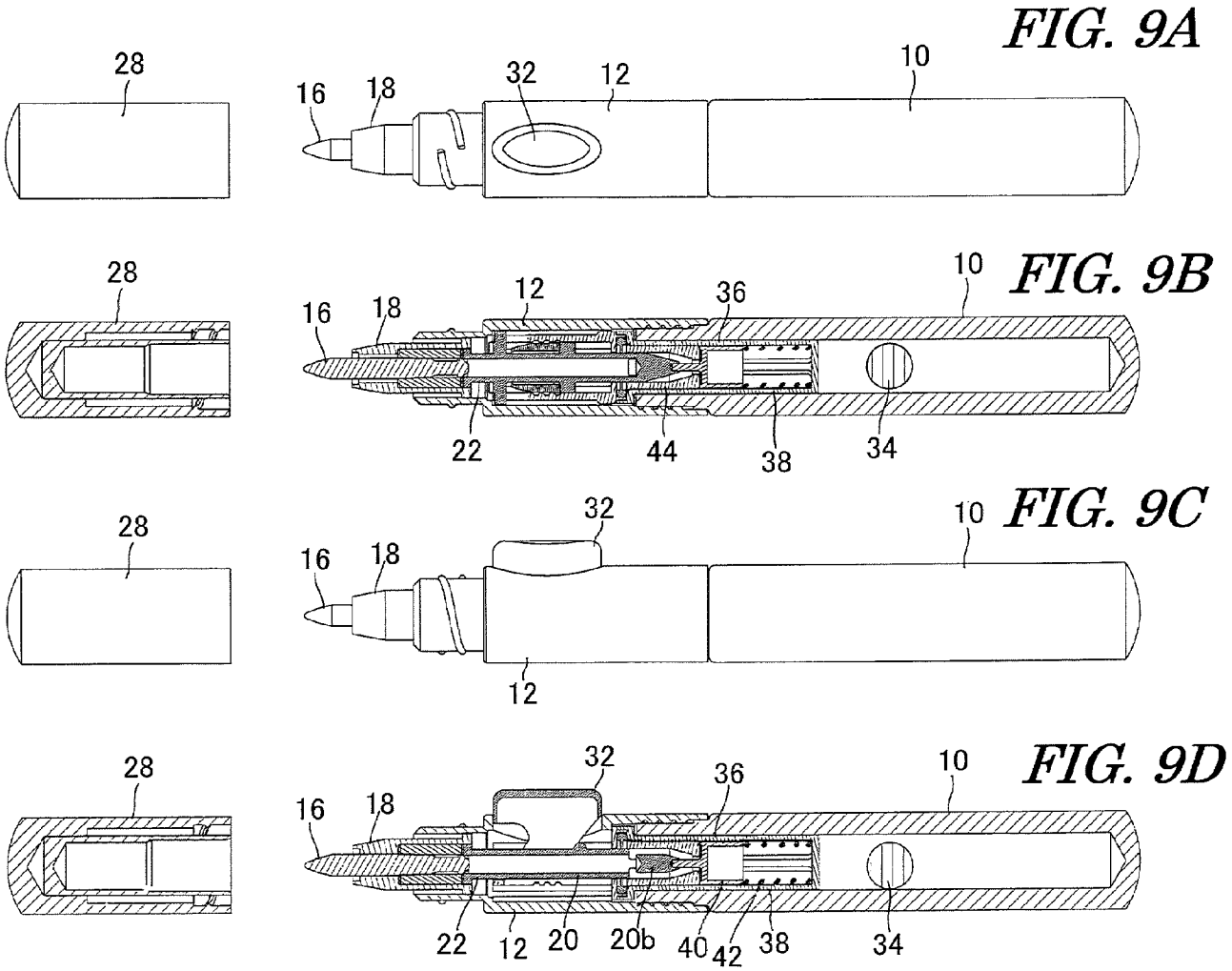
FIGS. 9A to 9D are illustrative diagrams showing a liquid applicator according to the second embodiment of the present invention with its cap removed, FIG. 9A a side view from the click button side, FIG. 9B a vertical sectional view of FIG. 9A, FIG. 9C a side view with the click button put upward, and FIG. 9D a vertical sectional view of FIG. 9C.
Figure 10A:
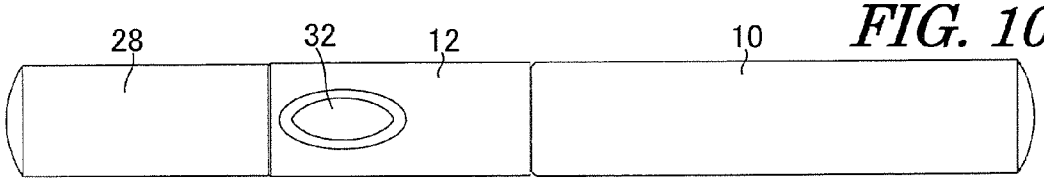
FIGS. 10A to 10D are illustrative diagrams showing the same liquid applicator with its cap attached, FIG. 10A a side view from the click button side, FIG. 10B a vertical sectional view of FIG. 10A, FIG. 10C a side view with the click button put upward, and FIG. 10D a vertical sectional view of FIG. 10C.
Figure 10B:
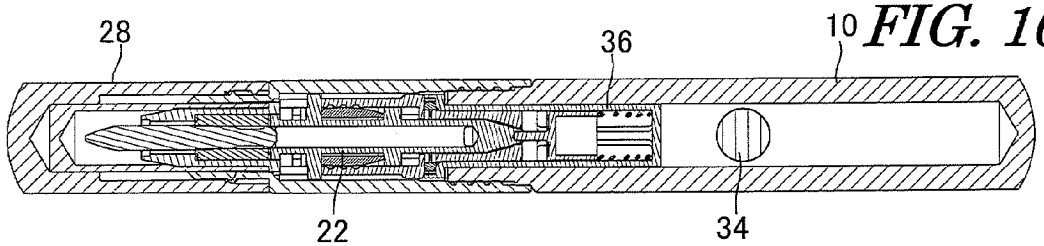
Figure 10C:
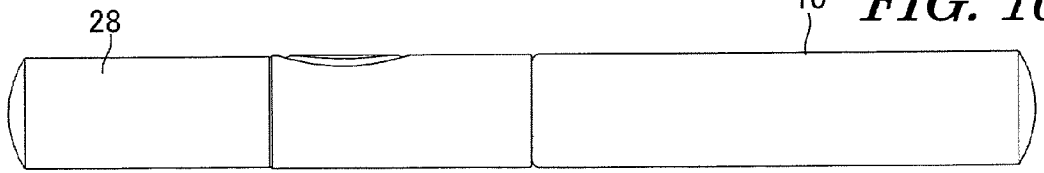
Figure 10D:
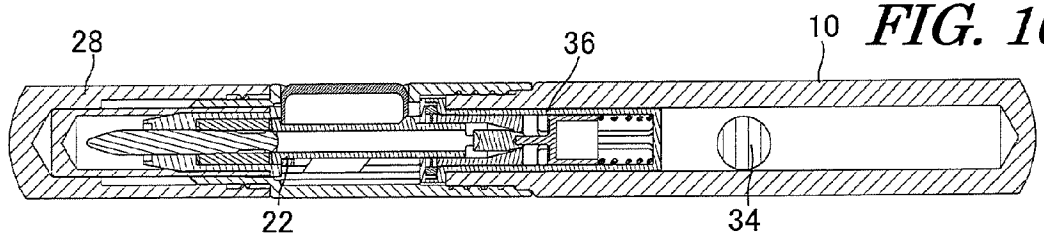
Figure 11A:
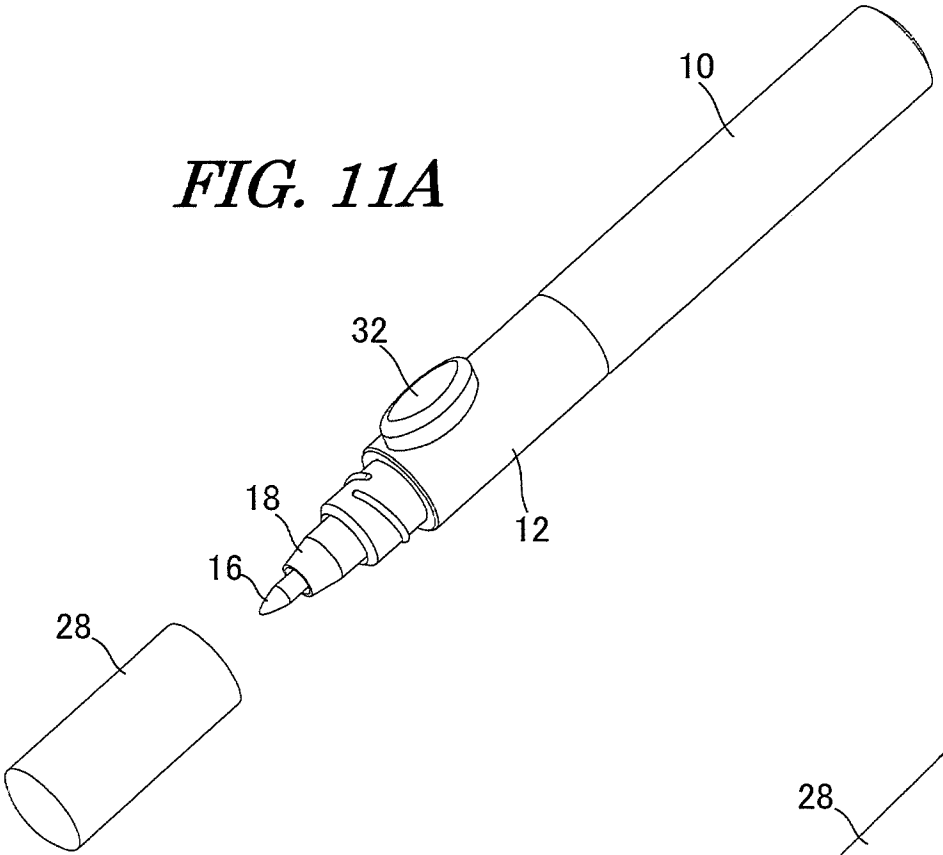
FIGS. 11A and 11B are perspective diagrams showing the same liquid applicator, FIG. 11A an illustrative view with its cap removed and FIG. 11B an illustrative view with the cap attached.
Figure 11B:
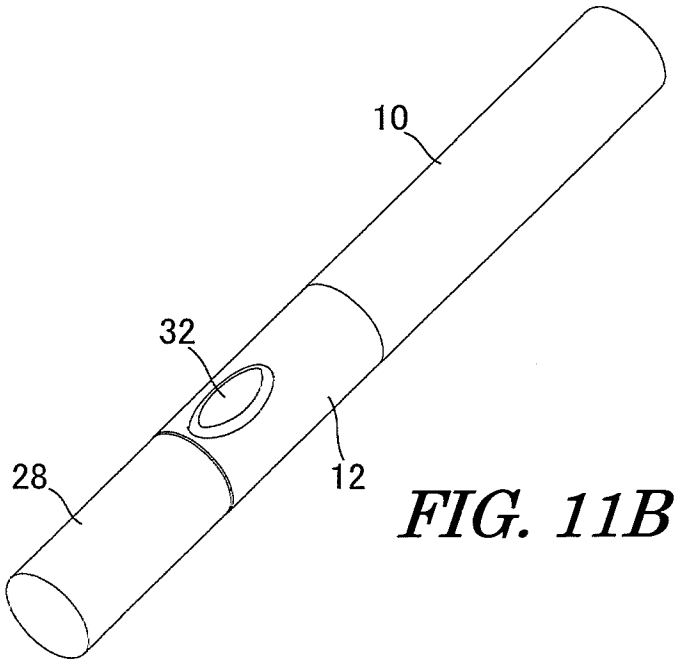

Next, the liquid applicator of the second embodiment will be described. FIG. 9 are illustrative diagrams showing a liquid applicator according to the second embodiment of the present invention with its cap removed. FIG. 10 are illustrative diagrams showing the same liquid applicator with its cap attached, FIG. 11 are perspective diagrams of the same liquid applicator, and, FIG. 12 are enlarged sections showing the front end side of the same liquid applicator.

In the liquid applicator of the second embodiment, a valve rod is arranged inside a valve set 36 so as to integrally operate with the application body and deliver the liquid while the interior of barrel body 10 is isolated from the application core when cap 28 is released.

This liquid applicator is provided with valve set 36 different from valve set 14 of the first embodiment. As shown in detail in FIG. 12, this valve set 36 includes a cylindrical spring socket 38 inserted into opening portion 10*a* of barrel body 10, a valve rod 40 and spring 42 disposed inside this spring socket 38 and a valve seat 44 arranged in front of valve rod 40 inside spring socket 38.

Figure 12A:
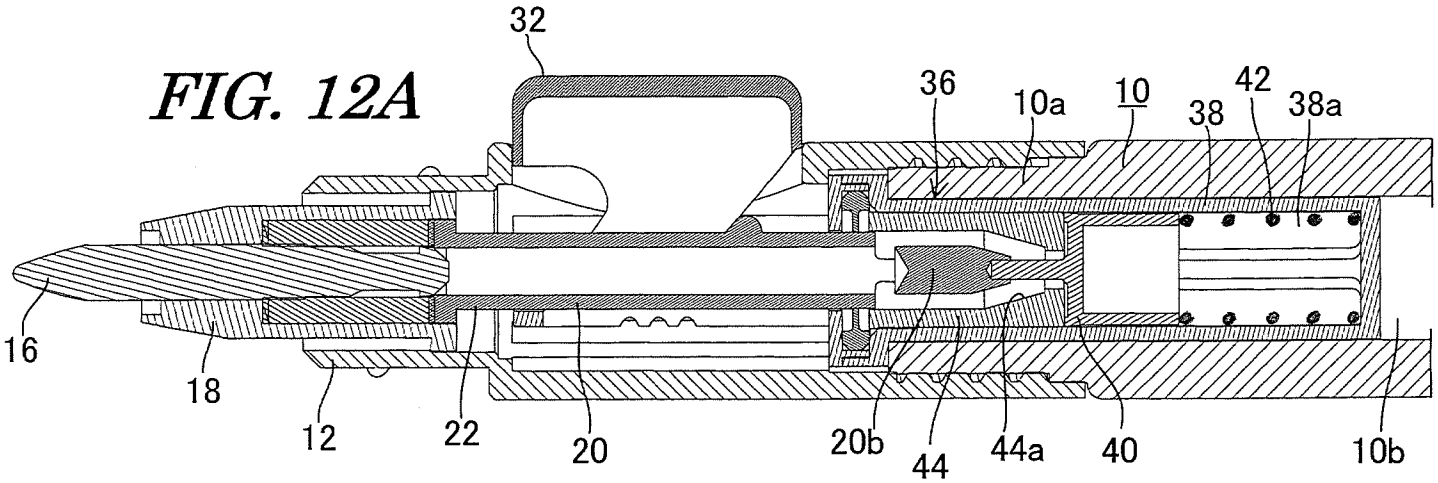
FIGS. 12A and 12B are enlarged sections showing the front end side of the same liquid applicator, FIG. 12A an illustrative view with the cap removed and FIG. 12B an illustrative view with the cap attached.
Figure 12B:
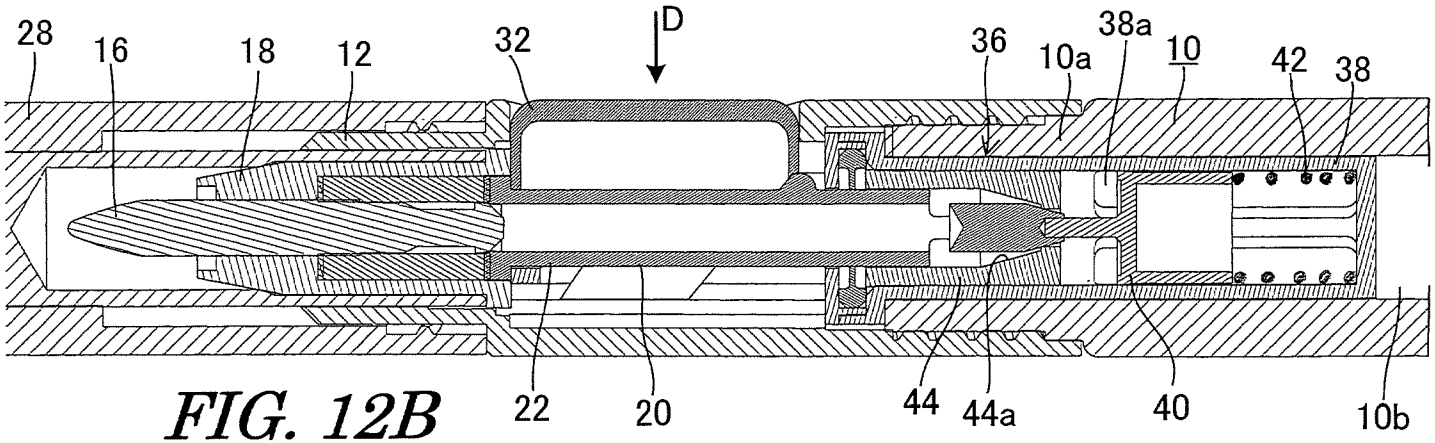
Figure 13:
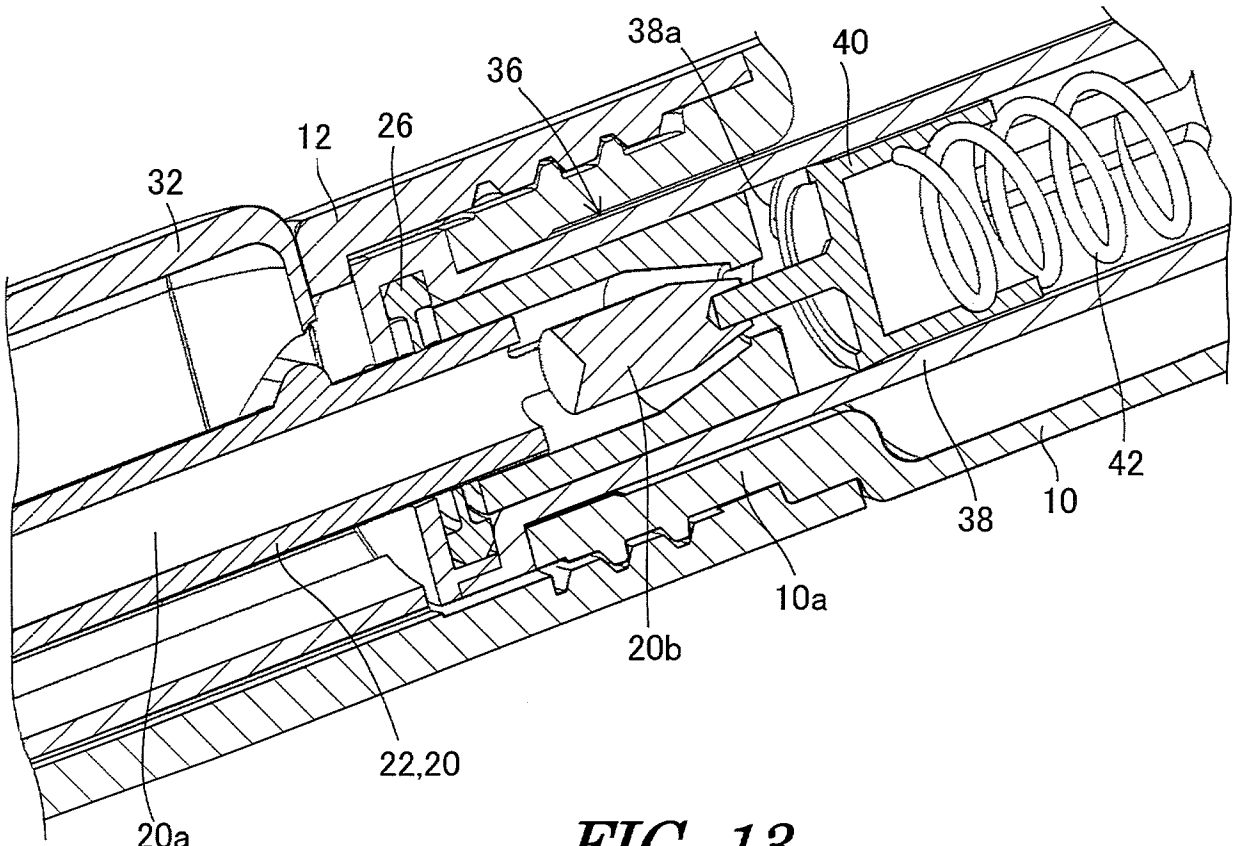
FIG. 13 is an enlarged sectional view showing the details around a valve set of the same liquid applicator; and, FIGS. 14A and 14B are vertical perspective diagrams of the same liquid applicator, FIG. 14A an illustrative view at the time of being not clicked, and FIG. 14B an illustrative view at the time of being clicked.

Detailedly, as shown in FIGS. 12 and 13, spring socket 38 is closed on the rear end but has a plurality of communication slots 38*a* in the form of slit openings on the peripheral side. These communication slots 38*a* establish communication with the interior of main part 10*b* of barrel body 10. Valve rod 40 has a thin diameter shaft in the front part and a cup-like part on the rear part and is slidably disposed inside spring socket 38.

Inside spring socket 38, valve seat 44 is formed with a tapered portion 44*a* defining the inter space that becomes narrower to the rear while a sealing portion 20*b* tapering to the rear is integrally formed in the rear end of ink feed pipe. Since the other configurations are the same as those of the liquid applicator of the first embodiment, the same components are allotted with the same reference numerals without description.

Figure 14A:
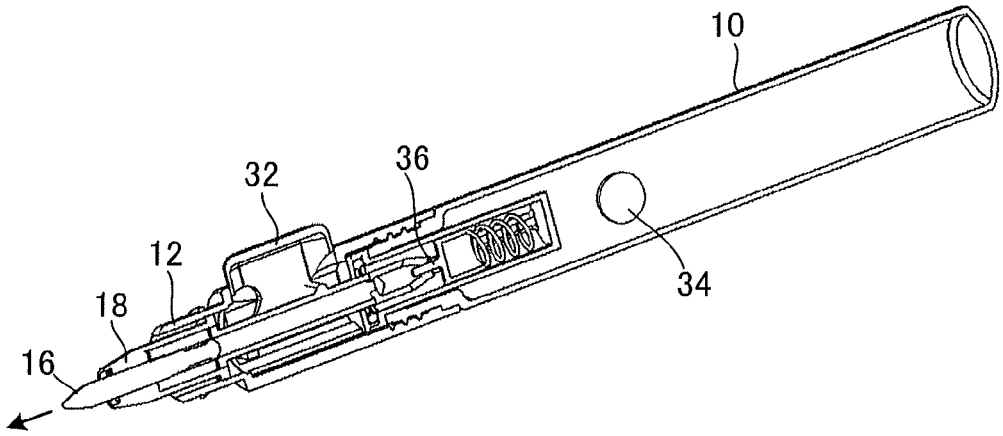
Figure 14B:
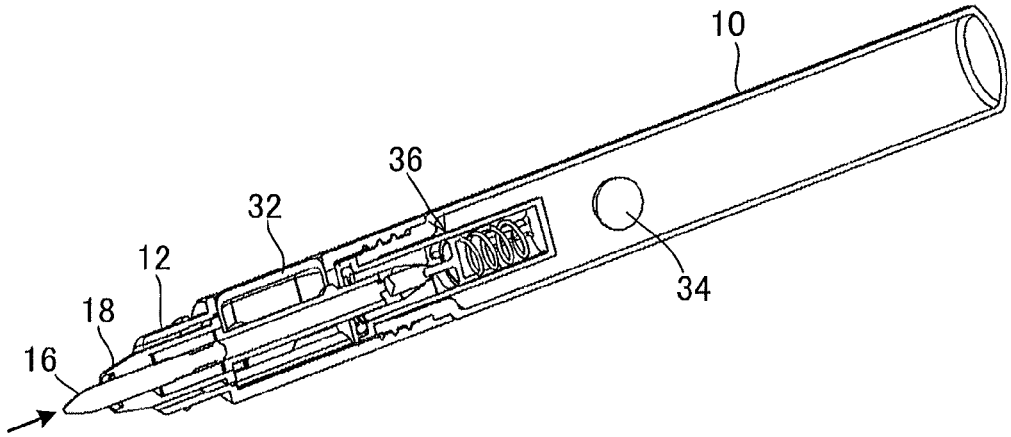

According to the liquid applicator of the second embodiment, at the time of non-clicking, click button 32 is raised and application body 22 is located at a forward position, as shown in FIGS. 9, 12A and 14A. In this condition, sealing part 20 is off valve seat 44, but the front end of valve rod 40 is fitted in the hole of valve seat 44 while communication slots 38*a* are confined by the peripheral side of the rear part of valve rod 40.

At the time of being clicked, click button 32 downs so that ink feed tube 20 of application body 22 moves rearward and the hole at the rear end of the sealing part 20*b* fits on the front end of the valve rod 40 to thereby move the valve rod 40 rearward.

Then, as valve rod 40 moves rearward by a predetermined distance or greater, communication slots 38*a* of spring socket 38, which have been confined by valve rod 40 open. The application liquid flows forward of valve rod 40, passing through communication slots 38*a*. At the same time, sealing part 20*b* of ink feed pipe 20 abuts tapered part 44*a* of valve seat 44 to establish sealing (water-tightness) so that after that no application liquid will flow in through the communication slots 38*a*.

According to the liquid applicator of the second embodiment, in addition to the operation and effect of the first embodiment, provision of a structure in which valve rod 40 is arranged inside valve set 36 and integrally operates with application body 22 to deliver the liquid while at the time of cap 28 being removed, the application core is cut off the interior of barrel body 10, produces the effect of delivering the content liquid from barrel body 10 that is at negative pressure. Further, even when cap 28 remains open, communication slots 38 are confined by the peripheral side of valve rod 40 and the valve set is closed, so that there is no fear of liquid leakage.

Furthermore, according to the liquid applicators of the first and second embodiments, use of screw fitting between cap 28 and front barrel 12 produces excellent effect such as making it possible to securely fix application body 22 that is urged to the writing point side.

The liquid applicator of the present invention can be used as a side-clicking feed type liquid applicator that can feed a liquid cosmetic, writing ink, correction ink, etc. by the operation of the click button on the peripheral side.

What is claimed is:

1. A liquid applicator comprising:

a barrel body with an opening for holding a content liquid therein;

a front barrel;

a valve set held and fixed between the opening of the barrel body and the front barrel;

an application body, integrally formed of an application core, a holder for the application core and an ink feed pipe, and disposed inside the front barrel, the application body being urged by a spring to a front end side of the applicator, slidable in an axial direction and slidable in the valve set, the ink feed pipe being sealed by a packing inside the valve set;

a cap fitted to the front barrel and having a sealing part with the application body; and, a click button arranged on a peripheral side of the front barrel to open and close the valve set, and wherein an inclined portion formed in the click button is engaged with an application body projection provided for the application body in such a manner that the application body moves forward and backward in the axial direction of the barrel body as the click button moves up and down from the peripheral side of the front barrel in a radial direction of the front barrel, the application body that is urged to the applicator front end side slides to the applicator front end side when the cap is released, and upon this, the click button is actuated in linkage by an inclined part of the click button being pushed by the application body projection so that the click button moves up and juts out from the peripheral side of the front barrel and the valve set opens at approximately the same time, upon usage, when the jutting click button is pushed and released, the application body is slid in the axial direction by the abutment between the inclined part of the click button and the application body projection so as to be able to open and close the valve set, and, when the cap is closed, the application body that is urged to the applicator front end side is slid to the barrel body side, and another inclined part of the click button pushes another projection of the application body so that the click button moves down in linkage therewith and retracts into the front barrel, and the valve set is closed at the same time.

2. Liquid applicator according to claim 1, wherein a valve rod is arranged inside the valve set so as to integrally operate with the application body, deliver the liquid, and cut off an interior of the barrel body from the application core when the cap is released.

3. Liquid applicator according to claim 1, wherein the cap and the front barrel are screw fitted to each other.

* * * * *